US011131150B2

(12) United States Patent
Randle

(10) Patent No.: US 11,131,150 B2
(45) Date of Patent: Sep. 28, 2021

(54) BOTTOM HOLE ASSEMBLIES

(71) Applicant: HALLIBURTON ENERGY SERVICES, INC., Houston, TX (US)

(72) Inventor: Hartley Randle, Spruce Grove (CA)

(73) Assignee: Halliburton Energy Services, Inc., Houston, TX (US)

( * ) Notice: Subject to any disclaimer, the term of this patent is extended or adjusted under 35 U.S.C. 154(b) by 26 days.

(21) Appl. No.: 16/079,415

(22) PCT Filed: May 25, 2016

(86) PCT No.: PCT/US2016/034070
§ 371 (c)(1),
(2) Date: Aug. 23, 2018

(87) PCT Pub. No.: WO2017/196375
PCT Pub. Date: Nov. 16, 2017

(65) Prior Publication Data

US 2019/0010766 A1 Jan. 10, 2019

Related U.S. Application Data

(60) Provisional application No. 62/335,063, filed on May 11, 2016.

(51) Int. Cl.
*E21B 17/03* (2006.01)
*E21B 17/042* (2006.01)
*E21B 17/043* (2006.01)

(52) U.S. Cl.
CPC ..... *E21B 17/03* (2013.01); *E21B 17/043* (2013.01); *E21B 17/0423* (2013.01)

(58) Field of Classification Search
CPC ..... E21B 17/03; E21B 17/0423; E21B 17/043
See application file for complete search history.

(56) References Cited

U.S. PATENT DOCUMENTS 4,802,805 A * 2/1989 Hattan ..... B23K 15/0006 411/263
2002/0076273 A1 6/2002 Carstensen
(Continued)

FOREIGN PATENT DOCUMENTS

WO 98/50720 A1 11/1998

OTHER PUBLICATIONS

International Search Report, of the Korean Intellectual Propety Office, as ISA, dated Feb. 6, 2017, in corresponding International Patent Application No. PCT/US2016/034070.

*Primary Examiner* — Caroline N Butcher
(74) *Attorney, Agent, or Firm* — Locke Lord LLP

(57) ABSTRACT

A bottom hole assembly may include a shaft having threads, a first fastener member positioned on the shaft, the first fastener member having first fastener threads that mesh with a first portion of the threads on the shaft, and a second fastener member positioned downhole of the first fastener member on the shaft, the second fastener member having second fastener threads that mesh with a second portion of the threads on the shaft, wherein the first fastener member and the second fastener member interact with each other such that an uphole face of the first fastener threads are pressed against a downhole face of the first portion of the threads on the shaft and a downhole face of the second fastener threads are pressed against an uphole face of the second portion of the threads on the shaft.

13 Claims, 3 Drawing Sheets

(56) References Cited

U.S. PATENT DOCUMENTS

| | | | | |
|---|---|---|---|---|
| 2011/0031020 | A1 | 2/2011 | Cote | |
| 2012/0195542 | A1* | 8/2012 | Marchand | E21B 4/003 384/606 |

* cited by examiner

BOTTOM HOLE ASSEMBLIES

BACKGROUND

1. Field

The present disclosure relates generally to bottom hole assemblies used in oil and gas drilling operations, and more specifically to methods and systems for reducing mechanical stresses in such bottom hole assemblies.

2. Description of Related Art

A bottom hole assembly ("BHA") is normally the lowest part of a drill string and thus the part that affects the trajectory of a wellbore as the drill string rotates. A typical BHA may include a drill collar having a mandrel connected thereto, a stabilizer, reamer, sensor, mud motor, and drill bit. The BHA may also have tools and other components mounted thereon, such as measurement while drilling (MWD) and logging while drilling (LWD) tools. Smaller size components called "subs," which may include, for example, a short drill collar or a thread crossover, may be used to interconnect the various components on the BHA as needed.

For directional drilling operations, the BHA may further include a rotary steerable system connected to the mandrel. The rotary steerable system usually has a housing and a driveshaft within the housing that is connected to the drill bit. The driveshaft operates to rotate the drill bit to drill the wellbore during drilling operations. There are generally two types of rotary steerable systems: "point-the-bit" and "push-the-bit." For point-the-bit type systems, the driveshaft is actively bent internally to the housing to cause the drill bit to drill at a specified angle as the drill string rotates. For push-the-bit type systems, instead of bending the driveshaft, radially extendable pads on the outside of the housing are used to push directly against portions of the wellbore to cause the drill bit to drill at the specified angle.

In the above rotary steerable systems, as the drill string rotates, rotational torque is transferred from the mandrel to the driveshaft. A small amount of axial force, including weigh-on-bit ("WOB") and over pull, is also transferred to the driveshaft. Most of the axial force, however, is transferred to the housing, which needs to remain stationary or non-rotating as the drill string rotates. To allow the housing to remain stationary, the BHA may include a sub connected between the mandrel and the housing of the rotary steerable system that provides a rotational to non-rotational force transfer system.

Existing rotational to non-rotational force transfer systems leave the BHA overly susceptible to various mechanical stresses from operating conditions in the subterranean formation and/or repeated drill cycles. Among other things, these systems may allow slack to develop in the connection to the housing when the drill string switches from WOB to over pull. The slack may result in backlash or jarring that may damage and/or cause the housing, and hence the BHA, to fail.

Accordingly, what is needed is an improved rotational to non-rotational force transfer system that reduces mechanical stress on the BHA during drilling operations.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
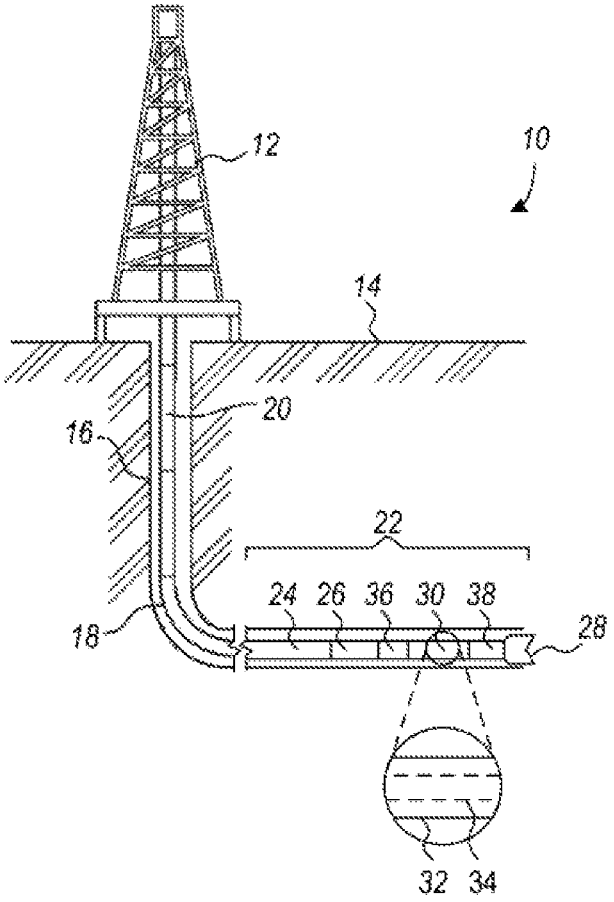
FIG. 1 is a schematic view of an oil or gas well in which an embodiment of a system in accordance with this disclosure may be used.

Reference will now be made to the drawings wherein like reference numerals identify similar structural features or aspects of the subject disclosure. As alluded to earlier, the embodiments disclosed herein relate to an improved rotational to non-rotational force transfer system for a BHA that reduces mechanical stresses from drilling operations. The rotational to non-rotational force transfer system allows the axial force on a drill string to be transferred to and subsequently from a non-rotational component, such as a housing of a rotary steerable system, with little or no backlash or jarring effect. In addition, the disclosed system, when properly assembled, is pre-loaded with a certain amount of tensile stress that helps offset compression stress from the axial force on the BHA. This further reduces the amount of mechanical stress experienced by the non-rotational component as well as the BHA overall.

Referring now to FIG. 1, an oil or gas well 10 is shown in which the rotational to non-rotational force transfer system disclosed herein may be used. The well 10 may include a drilling rig 12 located on a surface location 14 that may be used to drill a wellbore 16. The drilling rig 12 has a drill string 18 suspended therefrom composed of a continuous length of pipe known as drilling tubing that is made of relatively short pipe sections 20 connected (e.g., threaded) to one another. The drill string 18 typically has a BHA 22 attached at the end thereof that includes, among other things, a drill collar 24 connected to a driver 26, such as a tubular mandrel or the like, and a drill bit 28.

For directional drilling operations, the BHA 22 may also include a rotary steerable system 30. Examples of rotary steerable systems that may be used with the BHA 22 may include any of the Geo-Pilot® rotary steerable systems available from Halliburton Energy Services, Inc. The rotary steerable system 30 has, among other things, a housing 32 and a driveshaft 34 (see dashed lines) housed within the housing 32. The driveshaft 34 is connected to the drill bit 28 and may be operated to rotate the drill bit 28 to drill at a specified angle, thereby achieving directional drilling. A connection sub 36, sometimes called a driver sub, connects the driver 26 to the rotary steerable system 30. The driver sub 36 may be, or may provide, a rotational to non-rotational force transfer system that transfers rotational torque from the driver 26 to the driveshaft 34 while allowing the housing 32 to remain stationary or non-rotating. One or more measurement tools 38 may also be present on the BHA 22, including MWD and/or LWD tools, for obtaining measurements of various formation properties (e.g., resistivity, porosity, etc.) for the well 10.

In accordance with the disclosed embodiments, the rotational to non-rotational force transfer system provided by the driver sub 36 advantageously reduces mechanical stress resulting from the drilling operations. Specifically, the rotational to non-rotational force transfer system minimizes or prevents slack from developing in the connection between the driver sub 26 and the housing 32 as the axial force on the drill string 16 switches from WOB to over pull force. This significantly reduces or eliminates any backlash or jarring on the housing 32 during drilling operations. In addition, the disclosed rotational to non-rotational force transfer system, when assembled properly, is pre-loaded with a certain amount of tension stress that helps offset any compression stress from the WOB or the over pull force.

It should be noted that although the foregoing description discusses the disclosed embodiments in terms of a rotary steerable system on a BHA, these embodiments are not so limited. Those having ordinary skill in the art will understand that the concepts and principles taught herein may be used to reduce or eliminate backlash or jarring in any arrangement where axial force is transferred between two components connected to or otherwise mechanically engaged with one another. Following is a more detailed description of an exemplary implementation of the disclosed embodiments.

Figure 2:
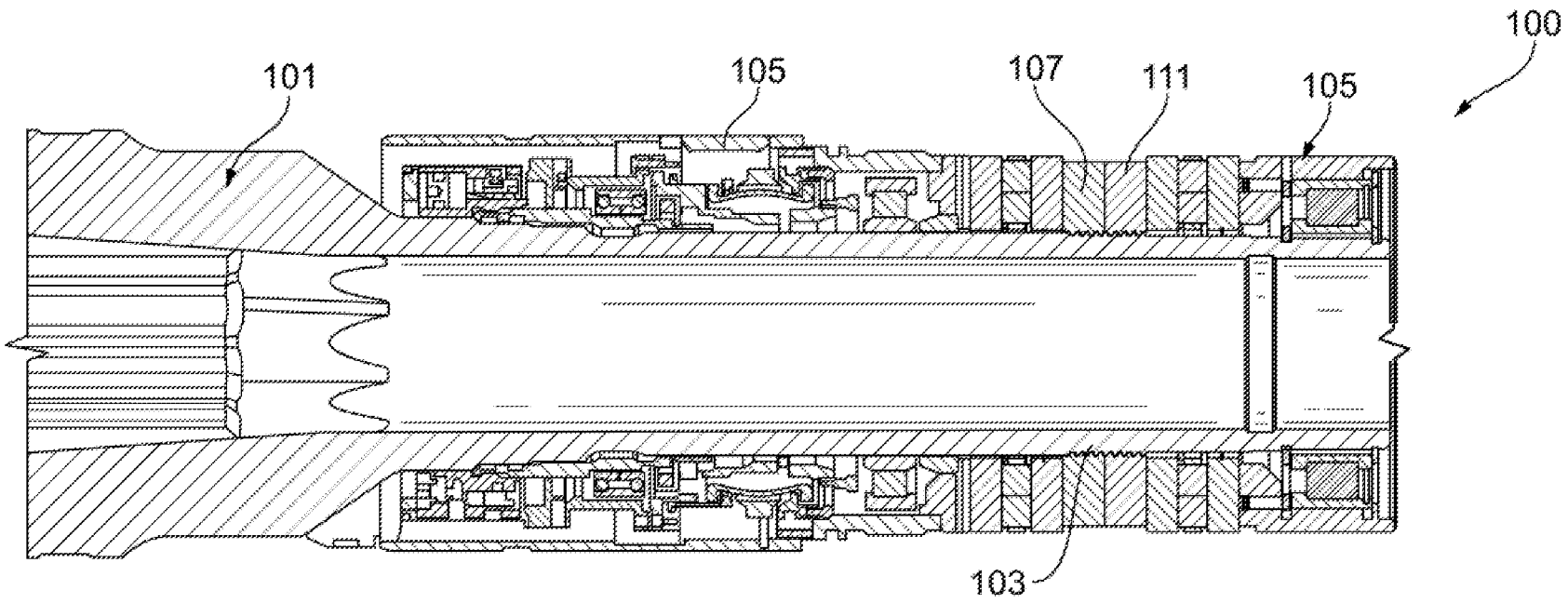
FIG. 2 is a cross-sectional view of an embodiment of a system in accordance with this disclosure.

Referring to FIG. 2, an exemplary implementation of a connection sub 101 or portion thereof is shown that is similar to the connection sub 36 described earlier with respect to FIG. 1. As can be seen, the connection sub 101 may include a substantially tubular shaft that may resemble a pipe section having threads 103 formed on an outer surface thereof. The specific connection sub 101 in this exemplary implementation may be a driver sub 101 that provides rotational to non-rotational force transfer for connecting a rotating component (e.g., driver 26, see FIG. 1) to a non-rotational component 105 (e.g., housing 32 of rotary steerable system 30). The driver sub 101 is rotatably mounted to the non-rotational component 105 and may be rotated to drive a drill bit (e.g., drill bit 28) to drill a wellbore. A first fastener member 107 resembling a nut or similar component having a threaded borehole formed therein is coaxially mounted on the driver sub 101. A second fastener member 111 is similarly mounted on the driver sub 101 downhole (i.e., to the right) of the first fastener member 107 and may also resemble a nut or other component having internal threads formed therein.

Figure 3:
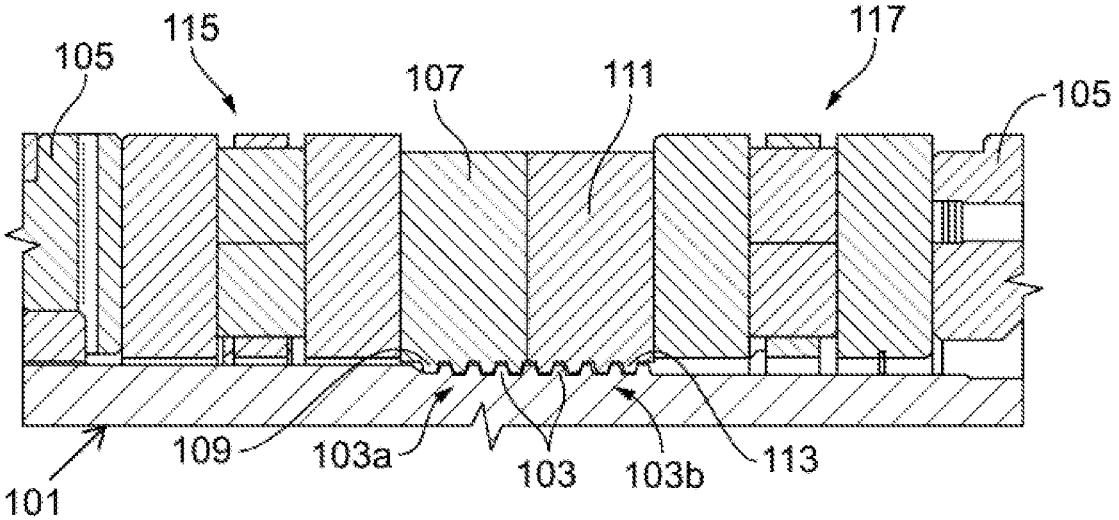
FIG. 3 is a zoomed cross-sectional view of a portion of the embodiment of FIG. 2.

A close-up view of the driver sub 101 is shown in FIG. 3. As can be seen, the first fastener member 107 includes first fastener threads 109 that are designed to mesh with or otherwise engage a first (i.e., uphole) portion 103*a* of the driver sub threads 103. The first fastener threads 109 may have any suitable shape, size, and/or pitch that meshes with at least the first portion 103*a* of the driver sub threads 103. The second fastener member 111 has second fastener threads 113 that are designed to mesh with or otherwise engage a second (i.e., downhole) portion 103*b* of the driver sub threads 103. The second fastener threads 113 may have any suitable shape, size, and/or pitch that meshes with at least the second portion 103*b* of the driver sub threads 103.

To achieve rotational to non-rotational force transfer, the first and second bearing members 115 and 117 may be coaxially mounted on the driver sub 101 on either side, respectively, of the driver sub threads 103. Each bearing member 115, 117 is designed to mechanically communicate or otherwise transfer axial load while also transmitting minimal or no rotational torque. In some embodiments, first and second bearing members 115 and 117 may be thrust bearings or similar components that have a rotable surface on one side and a non-rotable surface on an opposite side. The first bearing member 115 is positioned uphole of the first fastener member 107 on the driver sub 101, with the first fastener member 107 against one side of the first bearing member 115 and a rotating component (e.g., driver 26, see FIG. 1) against the other side. The second bearing member 117 is positioned downhole of the second fastener member 111 on the driver sub 101, with one side of the second bearing member 117 against the second fastener member 111 and the other side against the non-rotational component 105 (e.g., housing 32 of rotary steerable system 30). The above arrangement allows axial force to be transferred substantially freely to the non-rotational component 105 while little or no rotational torque is transferred thereto.

Figure 4:
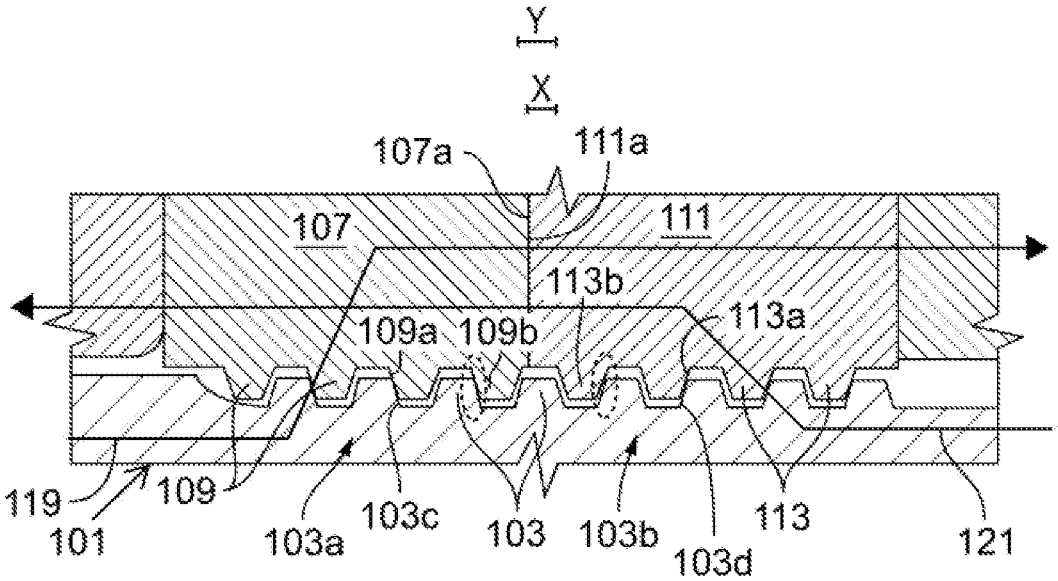
FIG. 4 is an even further zoomed cross-sectional view of the portion of the embodiment as shown in FIG. 2.

Assembly of the first and second fastener members 107, 111 is described with respect to FIG. 4, which shows a further close-up view of the driver sub 101. To properly assemble, the first fastener member 107 is threaded onto the driver sub 101 until the first fastener threads 109 mesh with or otherwise engage the first portion 103*a* of the driver sub threads 103. Then, the first fastener member 107 is held fixed in place while the second fastener member 111 is threaded onto the driver sub 101 until the second fastener threads 113 mesh with or otherwise engage the second portion 103*b* of the driver sub threads 103. The second fastener member 111 is thereafter tightened to the first fastener member 107, or vice versa, or both, until the first and second fastener members 107, 111 mutually push against one another. This tightening causes each of the first and second fastener threads 109, 113 to push against the driver sub threads 103 in an opposite direction from the other fastener threads 109, 113. More specifically, the tightening causes an uphole (or left) face 109*a* of the first fastener threads 109 to be pressed or otherwise engaged against a downhole (or right) face 103*c* of the first portion 103*a* of the driver sub threads 103, and a downhole (or left) face 113*a* of the second fastener threads 113 to be pressed or otherwise engaged against an uphole (or left) face 103*d* of the second portion 103*b* of the driver sub threads 103.

The mutually opposing thread engagements (see dashed ovals) advantageously result in the first and second fastener members 107, 111 mutually locking one another. More specifically, in this embodiment, the first and second fastener members 107, 111 are braced against each other such that each fastener member 107, 111 helps hold the other fastener member 107, 111 firmly in place on the driver sub 101 and prevents it from backing out. Other techniques for locking the first and second fastener members 107, 111 in place on the driver sub 101 may also be used (e.g., tapered threads) without departing from the disclosed embodiments. In either case, little or no slack develops between the two fastener members 107, 111 when axial force on the driver sub 101 switches from a downhole direction (e.g., WOB) to an uphole direction (e.g., over pull), and vice versa. Consequently, any backlash or jarring effect on the non-rotational component 105 is minimized and may be eliminated altogether in some embodiments. As well, the mutually opposing thread engagements pre-load the driver sub 101 with a certain amount of tensile stress that helps offset any compression stress resulting from the axial force on the driver sub 101, thereby further reducing the amount of mechanical stress on the non-rotational component 105.

In certain embodiments, referring still to FIG. 4, the first fastener threads 109 of the first fastener member 107 and the second fastener threads 113 of the second fastener member 111 may have the same pitch and/or diameter. In this regard, the driver sub threads 103 may have a uniform pitch and/or diameter (e.g., the first portion 103*a* of the driver sub threads 103 may have the same pitch as the second portion 103*b* of the driver sub threads 103). However, it is contemplated that the first portion 103*a* of the driver sub threads 103 may have a different pitch, diameter, or shape from the second portion 103*b* such that the first fastener threads 109 and the second fastener threads 113 are different and only mesh respectively with the first portion 103*a* and second portion 103*b*. For example, the first portion 103*a* of the driver sub threads 103 may have a larger outer diameter than the second portion 103*b* so the second fastener member 111 cannot slide over and/or mesh with the first portion 103*a*, while the first fastener member 107 may slide over the second portion 103*b*.

To avoid potential interference between the first and second fastener threads 109, 113 while the first and second fastener members 107, 111 are being tightened to each other, their respective threads 109, 113 may be trimmed or otherwise shortened so as to leave about ¼ inch to about ⅛ inch of clearance on either ends of the first and second fastener threads 109, 113. This clearance is indicated by line "X" in FIG. 4 for the most uphole thread 113*b* of the second fastener threads 113 and an uphole face 111*a* of the second fastener member 111. In certain embodiments, the clearance between the most downhole thread 109*b* of the first fastener threads 109 and a downhole face 107*a* of the first fastener member 107 may be the same as, or different from, the clearance for the second fastener member 111 due to manufacturing variability.

In certain embodiments, the above thread clearance should result in the distance between a thread on the first fastener member 107 and an immediately adjacent thread on the second fastener member 111 being sufficiently large to ensure the mutually opposing thread engagements described above when the second fastener member 111 is tightened to the first fastener member 107 (or vice versa). More specifically, the distance between the most downhole thread 109*b* of the first fastener threads 109 and the next or most uphole thread 113*b* of the second fastener threads 113, as indicated by line "Y" in FIG. 4, should be greater than the distance between any other two consecutive threads of the first fastener threads 109 and/or any other two consecutive threads of the second fastener threads 113.

Although not explicitly depicted, an additional advantage of the embodiments disclosed herein is the driver sub thread 103 has the effect of increasing the cross-section of the driver sub 101. This thicker cross-section adds stiffness to the driver sub 101, which helps prevents failure due to bending fatigue while drilling, particularly when multiple "dog legs" need to be drilled in the subterranean formation.

Accordingly, as set forth above, the embodiments disclosed herein may be implemented in a number of ways. For example, in general, in one aspect, the disclosed embodiments relate to a rotational to non-rotational force transfer system. The rotational to non-rotational force transfer system may comprise, among other things, a tubular shaft and a first bearing member coaxially mounted on the tubular shaft, the first bearing member providing rotational to non-rotational force transfer. The system may also comprise a first fastener member coaxially mounted on the tubular shaft and pressing against the first bearing member and a second fastener member coaxially mounted on the tubular shaft and pressing against the first fastener member. The system may further comprise a second bearing member coaxially mounted on the tubular shaft and pressing against the second fastener member, the second bearing member providing rotational to non-rotational force transfer.

In accordance with any one or more of the foregoing embodiments, threads are provided on the tubular shaft and internal threads are formed on the first and second fastener members, wherein the internal threads on the first and second fastener members push against the external threads on the tubular shaft in opposite directions when the first and second fastener members are tightened to each other.

In accordance with any one or more of the foregoing embodiments, a distance between an internal thread on the first fastener member and an immediately adjacent thread on the second fastener member is sufficiently large to ensure that the internal threads on the first and second fastener members push against the external threads on the tubular shaft in opposite directions.

In accordance with any one or more of the foregoing embodiments, the internal threads on the first fastener member have a different size, shape, or pitch from the internal threads on the second fastener member.

In accordance with any one or more of the foregoing embodiments, a first portion of the external threads on the tubular shaft have a different size, shape, or pitch from a second portion of the external threads on the tubular shaft.

In accordance with any one or more of the foregoing embodiments, the first and second fastener members resemble nuts having threaded boreholes therein.

In general, in another aspect, the disclosed embodiments relate to a bottom hole assembly. The bottom hole assembly may comprise, among other things, a drill bit, a rotational driveshaft connected to the drill bit, and a non-rotational housing around the driveshaft. The bottom hole assembly may also comprise a connection sub connected to the rotational driveshaft and the non-rotational housing, the connection sub including a rotational to non-rotational force transfer system. The bottom hole assembly may further comprise a first fastener member and a second fastener member in the rotational to non-rotational force transfer system, the first and second fastener members being tightened to each other on the connection sub.

In accordance with any one or more of the foregoing embodiments, the first and second fastener members are pre-loaded with a tensile stress that helps offset compression stress resulting from the axial force on the bottom more assembly.

In accordance with any one or more of the foregoing embodiments, threads are provided on the connection sub and internal threads are provided on the first and second fastener members, wherein the internal threads on the first and second fastener members push against the threads on the connection sub in opposite directions.

In accordance with any one or more of the foregoing embodiments, a distance between an internal thread on the first fastener member and an immediately adjacent internal thread on the second fastener member is sufficiently large to ensure that the internal threads on the first and second fastener members push against the threads on the connection sub in opposite directions.

In accordance with any one or more of the foregoing embodiments, the internal threads on the first fastener member have a different size, shape, or pitch from the internal threads on the second fastener member.

In accordance with any one or more of the foregoing embodiments, the first and second fastener members are nuts having threaded boreholes therein.

In accordance with any one or more of the foregoing embodiments, the rotational driveshaft and the non-rotational housing form part of a rotary steerable system.

In general, in yet another aspect, the disclosed embodiments relate to a method of reducing mechanical stress in a rotational to non-rotational force transfer system. The method comprises, among other things, mounting a first bearing member coaxially on a tubular shaft of the rotational to non-rotational force transfer system, the first bearing member coaxially mounted against a rotational component and providing rotational to non-rotational force transfer for the rotatable component. The method also comprises mounting a first fastener member coaxially on the tubular shaft of the rotational to non-rotational force transfer system, the first fastener member coaxially mounted against the first bearing member, and mounting a second fastener member coaxially on the tubular shaft of the rotational to non-rotational force transfer system, the second fastener member coaxially mounted against the first fastener member. The method further comprises tightening the first and second fastener members to each other and mounting a second bearing member coaxially on the tubular shaft of the rotational to non-rotational force transfer system, the second bearing member coaxially mounted against the second fastener member and providing rotational to non-rotational force transfer for a non-rotational component.

In accordance with any one or more of the foregoing embodiments, the first and second fastener members are preloaded with a tensile stress to help offset compression stress resulting from the axial force on the rotational to non-rotational force transfer system.

In accordance with any one or more of the foregoing embodiments, external threads are provided on the tubular shaft and internal threads are provided on the first and second fastener members, wherein the internal threads on the first and second fastener members push against the external threads on the tubular shaft in opposite directions when the first and second fastener members are tightened to each other.

In accordance with any one or more of the foregoing embodiments, a distance between an internal thread on the first fastener member and an immediately adjacent internal thread on the second fastener member is sufficiently large to ensure that the internal threads on the first and second fastener members push against the external threads on the tubular shaft in opposite directions when the first and second fastener members are tightened to each other.

In accordance with any one or more of the foregoing embodiments, the rotational component is a driver for a bottom hole assembly, the rotational to non-rotational force transfer system is part of a driver sub for the bottom hole assembly, and the non-rotational component is a housing for a rotary steerable system on the bottom hole assembly.

The methods and systems of the present disclosure, as described above and shown in the drawings, provide for drilling assemblies with superior properties including improved stress distribution. While the apparatus and methods of the subject disclosure have been shown and described with reference to embodiments, those skilled in the art will readily appreciate that changes and/or modifications may be made thereto without departing from the spirit and scope of the subject disclosure.

What is claimed is:

1. A rotational to non-rotational force transfer system, comprising:

a tubular shaft;

a first bearing member coaxially mounted on the tubular shaft against a rotational component and providing rotational to non-rotational force transfer for the rotatable component;

a first fastener member coaxially mounted on the tubular shaft against the first bearing member;

a second fastener member coaxially mounted on the tubular shaft against the first fastener member, the first and second fastener members being tightened to each other;

a second bearing member coaxially mounted on the tubular shaft against the second fastener member and providing rotational to non-rotational force transfer for a non-rotational component; and external threads on the tubular shaft and internal threads on the first and second fastener members, wherein the internal threads on the first and second fastener members push against the external threads on the tubular shaft in opposite directions when the first and second fastener members are tightened to each other;

wherein a distance between an internal thread on the first fastener member and an immediately adjacent internal thread on the second fastener member is selected to ensure that the internal threads on the first and second fastener members push against the external threads on the tubular shaft in opposite directions; and wherein the internal threads on the first fastener member have a different size, shape, or pitch from the internal threads on the second fastener member.

2. The system of claim 1, wherein a first portion of the external threads on the tubular shaft have a different size, shape, or pitch from a second portion of the external threads on the tubular shaft.

3. The system of claim 1, wherein the first and second fastener members resemble nuts having threaded boreholes therein.

4. The system claim 1, wherein the rotational component is a driver for a bottom hole assembly and the rotational to non-rotational force transfer system is part of a driver sub for the bottom hole assembly.

5. The system of claim 4, wherein the non-rotational component is a housing for a rotary steerable system on the bottom hole assembly.

6. A bottom hole assembly for a drill string, comprising:

a drill bit;

a rotational driveshaft connected to the drill bit;

a non-rotational housing enclosing the driveshaft;

a connection sub connected to the rotational driveshaft and the non-rotational housing, the connection sub including a rotational to non-rotational force transfer system; and a first fastener member and a second fastener member in the rotational to non-rotational force transfer system, the first and second fastener members tightened to each other on the connection sub;

wherein a distance between an internal thread on the first fastener member and an immediately adjacent internal thread on the second fastener member is selected to ensure that the internal threads on the first and second fastener members push against the threads on the connection sub in opposite directions; and wherein the internal threads on the first fastener member have a different size, shape, or pitch from the internal threads on the second fastener member.

7. The bottom hole assembly of claim 6, wherein the first and second fastener members are pre-loaded with a tensile stress that helps offset compression stress resulting from the axial force on the bottom more assembly.

8. The bottom hole assembly of claim 6, further comprising threads on the connection sub and internal threads on the first and second fastener members, wherein the internal threads on the first and second fastener members push against the threads on the connection sub in opposite directions.

9. The bottom hole assembly of claim 6, wherein the first and second fastener members are nuts having threaded boreholes therein.

10. The bottom hole assembly of claim 6, wherein the rotational driveshaft and the non-rotational housing form part of a rotary steerable system.

11. A method of reducing mechanical stress in a rotational to non-rotational force transfer system, comprising:

mounting a first bearing member coaxially on a tubular shaft of the rotational to non-rotational force transfer system, the first bearing member coaxially mounted against a rotational component and providing rotational to non-rotational force transfer for the rotatable component;

mounting a first fastener member coaxially on the tubular shaft of the rotational to non-rotational force transfer system, the first fastener member coaxially mounted against the first bearing member;

mounting a second fastener member coaxially on the tubular shaft of the rotational to non-rotational force transfer system, the second fastener member coaxially mounted against the first fastener member;

tightening the first and second fastener members to each other;

mounting a second bearing member coaxially on the tubular shaft of the rotational to non-rotational force transfer system, the second bearing member coaxially mounted against the second fastener member and providing rotational to non-rotational force transfer for a non-rotational component; and providing external threads on the tubular shaft and internal threads on the first and second fastener members, wherein a distance between an internal thread on the first fastener member and an immediately adjacent internal thread on the second fastener member is selected to ensure that the internal threads on the first and second fastener members push against the external threads on the tubular shaft in opposite directions when the first and second fastener members are tightened to each other; and wherein the internal threads on the first fastener member have a different size, shape, or pitch from the internal threads on the second fastener member.

12. The method of claim 11, further comprising preloading the first and second fastener members with a tensile stress to help offset compression stress resulting from the axial force on the rotational to non-rotational force transfer system.

13. The method of claim 11, wherein the rotational component is a driver for a bottom hole assembly, the rotational to non-rotational force transfer system is part of a driver sub for the bottom hole assembly, and the non-rotational component is a housing for a rotary steerable system on the bottom hole assembly.

* * * * *